US009835187B2

(12) United States Patent
Egawa et al.

(10) Patent No.: US 9,835,187 B2
(45) Date of Patent: Dec. 5, 2017

(54) CONTROL SYSTEM FOR CONSTRUCTION MACHINE

(71) Applicant: KAYABA INDUSTRY CO., LTD., Tokyo (JP)

(72) Inventors: Masahiro Egawa, Saitama (JP); Haruhiko Kawasaki, Kanagawa (JP); Yasuhiro Yonehara, Kanagawa (JP)

(73) Assignee: KYB Corporation, Tokyo (JP)

( * ) Notice: Subject to any disclaimer, the term of this patent is extended or adjusted under 35 U.S.C. 154(b) by 337 days.

(21) Appl. No.: 14/406,535

(22) PCT Filed: Jul. 23, 2013

(86) PCT No.: PCT/JP2013/069930

§ 371 (c)(1),
(2) Date: Dec. 9, 2014

(87) PCT Pub. No.: WO2014/017492

PCT Pub. Date: Jan. 30, 2014

(65) Prior Publication Data

US 2015/0152900 A1 Jun. 4, 2015

(30) Foreign Application Priority Data

Jul. 25, 2012 (JP) ..... 2012-164518

(51) Int. Cl.
*F15B 21/14* (2006.01)
*E02F 9/22* (2006.01)
*E02F 9/20* (2006.01)

(52) U.S. Cl.
CPC ..... *F15B 21/14* (2013.01); *E02F 9/2095* (2013.01); *E02F 9/2217* (2013.01); *E02F 9/2285* (2013.01); *E02F 9/2292* (2013.01); *E02F 9/2296* (2013.01); *F15B 2211/20507* (2013.01); *F15B 2211/40515* (2013.01);
(Continued)

(58) Field of Classification Search
CPC ..... F15B 21/14; F15B 2211/88; E02F 9/2217
See application file for complete search history.

(56) References Cited

U.S. PATENT DOCUMENTS 6,725,581 B2 * 4/2004 Naruse ..... E02F 9/2217 37/348
2012/0304630 A1 12/2012 Kawasaki et al.

FOREIGN PATENT DOCUMENTS

JP 2000-170705 A 6/2000
JP 2003-329012 A 11/2003
(Continued)

*Primary Examiner* — F. Daniel Lopez
(74) *Attorney, Agent, or Firm* — Rabin & Berdo, P.C.

(57) ABSTRACT

A control system for a construction machine includes: a boom cylinder; a boom switching valve; a fluid pressure motor adapted to drive a motor generator by being rotated by means of a return fluid guided from a piston side chamber; a regeneration control valve adapted to adjust a first supply amount serving as a supply amount of a working fluid supplied from the piston side chamber to the boom switching valve, and a second supply amount serving as a supply amount of the working fluid supplied from the piston side chamber to the fluid pressure motor; and a controller adapted to control the regeneration control valve so that the second supply amount becomes smaller than the first supply amount in a case where a stroke amount of a spool becomes an upper limit value or more.

4 Claims, 3 Drawing Sheets

(52) U.S. Cl.
CPC ..... *F15B 2211/411* (2013.01); *F15B 2211/41527* (2013.01); *F15B 2211/41581* (2013.01); *F15B 2211/46* (2013.01); *F15B 2211/7053* (2013.01); *F15B 2211/7058* (2013.01); *F15B 2211/761* (2013.01)

(56) References Cited

FOREIGN PATENT DOCUMENTS

| | | | |
|---|---|---|---|
| JP | 2007-263157 | A | 10/2007 |
| JP | 2011-179541 | A | 9/2011 |
| JP | 2012-013160 | A | 1/2012 |

* cited by examiner

CONTROL SYSTEM FOR CONSTRUCTION MACHINE

TECHNICAL FIELD

The present invention relates to a control system for a construction machine in which a return fluid of a boom cylinder is used as a regeneration flow rate.

BACKGROUND ART

JP2011-179541A discloses a control device for rotating a fluid pressure motor by utilizing a return fluid of a boom cylinder to rotate a motor generator by rotation force of the fluid pressure motor. In this control device, a regeneration control valve is provided in a process of a passage connecting a piston side chamber of the boom cylinder and a boom switching valve, and the regeneration control valve is connected to a regeneration flow passage connected to the fluid pressure motor.

In a case where the regeneration control valve is placed at a normal position, communication between the piston side chamber and the regeneration flow passage is blocked. In a case where the regeneration control valve is placed at a regeneration control position serving as a switching position, part of the return fluid is supplied to the regeneration flow passage as a regeneration flow rate. In a switching process where the regeneration control valve is switched from the normal position to the switching position, an opening degree of the regeneration flow passage is continuously changed, and the regeneration flow rate is controlled in accordance with the opening degree of the regeneration flow passage.

An opening degree of the regeneration control valve is controlled in accordance with an output signal of a controller. The controller controls the opening degree of the regeneration control valve in accordance with a spool stroke of the boom switching valve for controlling the boom cylinder. That is, the controller is configured so that the larger the spool stroke becomes, the larger the opening degree of the regeneration control valve becomes, thereby increasing the regeneration flow rate guided to the fluid pressure motor.

When a fluid is supplied to the fluid pressure motor, the fluid pressure motor is rotated and a motor generator linked with the fluid pressure motor is rotated to perform power generation. An assist pump to be rotated coaxially with the fluid pressure motor is linked with the motor generator, and the assist pump is driven and rotated by means of power of the motor generator.

SUMMARY OF INVENTION

In the above conventional device, as the spool stroke of the boom switching valve is larger, the opening degree of the regeneration control valve is increased more. Thus, the rotation of the fluid pressure motor is increased in accordance with an increase in the opening degree of the regeneration control valve, whereby an output of the motor generator may exceed rated power. When the output of the motor generator exceeds the rated power, there is a possibility that breakage of the motor generator is caused.

It is an object of the present invention to provide a control system for a construction machine, capable of preventing a motor generator from exceeding rated power.

According to an aspect of the present invention, there provided a control system for a construction machine, including: a boom cylinder partitioned into a piston side chamber and a rod side chamber by a piston, the boom cylinder operating so as to be extended and contracted by supplying a working fluid to the piston side chamber or the rod side chamber, thereby driving a boom; a boom switching valve adapted to adjust a supply amount of the working fluid to be supplied to the piston side chamber or the rod side chamber by means of a stroke of a spool; a fluid pressure motor adapted to drive a motor generator by being rotated by means of a return fluid guided from the piston side chamber; a regeneration control valve adapted to communicate the piston side chamber with the boom switching valve and the fluid pressure motor, the regeneration control valve being adapted to adjust a first supply amount and a second supply amount, the first supply amount serving as a supply amount of the working fluid supplied from the piston side chamber to the boom switching valve, the second supply amount serving as a supply amount of the working fluid supplied from the piston side chamber to the fluid pressure motor; and a controller adapted to control the regeneration control valve so that the second supply amount becomes smaller than the first supply amount in a case where a stroke amount of the spool becomes an upper limit value or more.

DESCRIPTION OF EMBODIMENTS

Hereinafter, embodiments of the present invention will be described with reference to the accompanying drawings.

Figure 1:
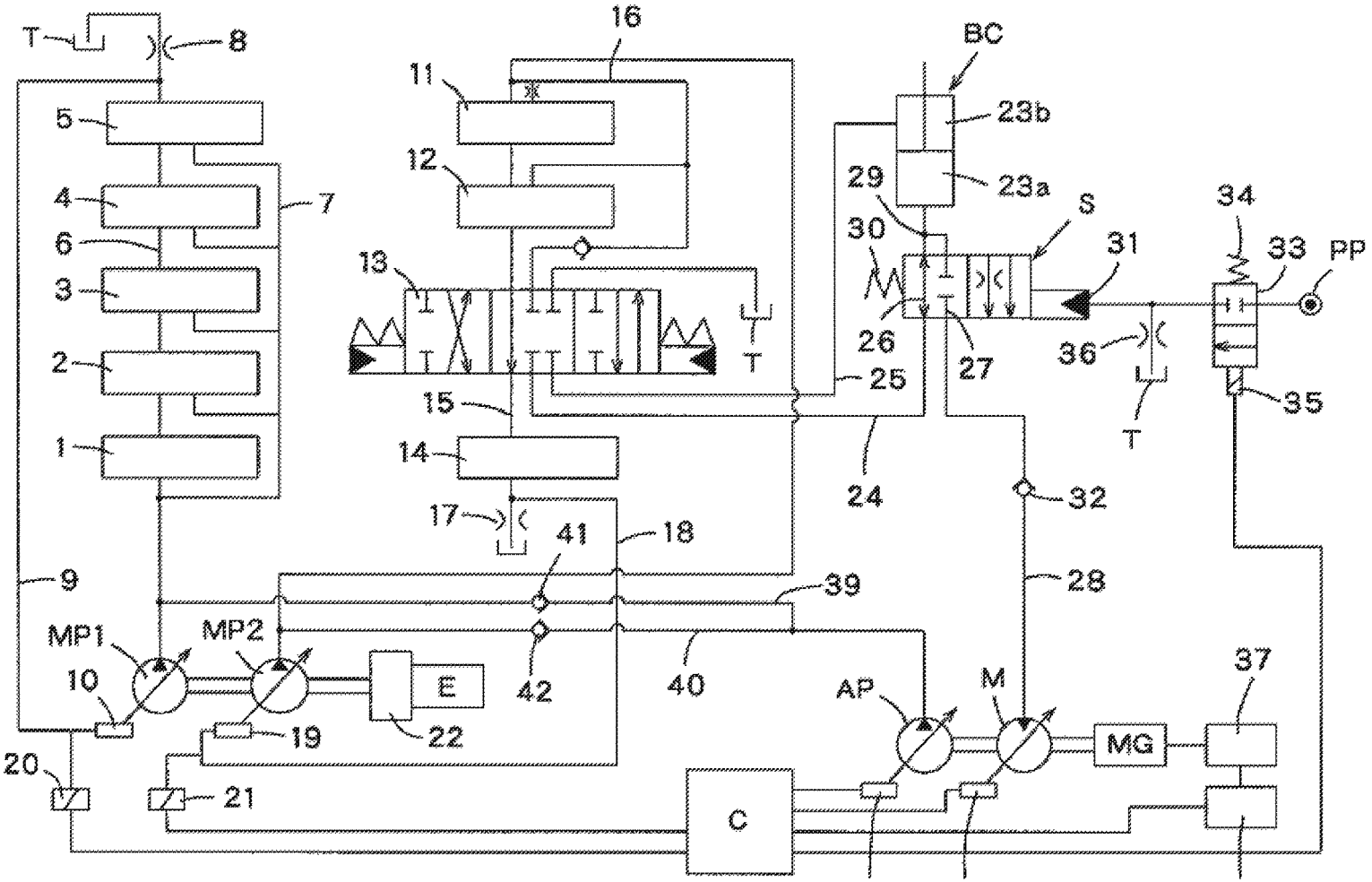
FIG. 1 is a hydraulic circuit diagram of a control system for a construction machine according to a first embodiment of the present invention.

Referring to FIG. 1, a first embodiment will be described.

A control system for a construction machine includes first and second main pumps MP1 and MP2 of variable capacity type. The first main pump MP1 is connected to a first circuit system, and the second main pump MP2 is connected to a second circuit system.

The first circuit system includes: a switching valve 1 for controlling a turning motor; a switching valve 2 for controlling an arm cylinder; a boom dual-speed switching valve 3 for controlling a boom cylinder BC; a switching valve 4 for controlling a spare attachment; and a switching valve 5 for controlling a left-hand side traveling motor in order from the upstream side.

The respective switching valves 1 to 5 are connected in series via a neutral flow passage 6, and connected in parallel via a parallel passage 7. The neutral flow passage 6 and the parallel passage 7 are connected to the first main pump MP1. A pilot pressure control throttle 8 for generating pilot pressure is connected to the neutral flow passage 6 on the downstream side of the switching valve 5 for the left-hand side traveling motor. The throttle 8 generates higher pilot pressure on the upstream side of the throttle 8 as a flow rate of a working fluid flowing through the throttle 8 is greater.

In a case where all the switching valves 1 to 5 are respectively placed at neutral positions or in the vicinity of the neutral positions, the neutral flow passage 6 guides all or part of the working fluid supplied from the first main pump MP1 to the first circuit system to a tank T via the throttle 8.

In this case, since the flow rate passing through the throttle 8 is great, high pilot pressure is generated on the upstream side of the throttle 8.

On the other hand, when each of the switching valves 1 to 5 is switched into a full stroke state, the neutral flow passage 6 is closed and a flow of the fluid is stopped. Therefore, in this case, since there is no flow rate flowing through the throttle 8, the pilot pressure is maintained to be zero. It should be noted that depending on operation amounts of the switching valves 1 to 5, part of a pump discharge amount is guided to an actuator and part thereof is guided to the tank T from the neutral flow passage 6. In this case, the throttle 8 generates the pilot pressure in accordance with a flow rate flowing through the neutral flow passage 6. That is, the throttle 8 generates the pilot pressure in accordance with the operation amounts of the switching valves 1 to 5.

A pilot flow passage 9 is connected to the neutral flow passage 6 between the switching valve 5 and the throttle 8. The pilot flow passage 9 is connected to a regulator 10 for controlling a tilting angle of the first main pump MP1. The regulator 10 controls the tilting angle of the first main pump MP1 in inverse proportion to pilot pressure of the pilot flow passage 9, and controls a displacement amount per one rotation of the first main pump MP1. Therefore, when the flow of the neutral flow passage 6 is stopped and the pilot pressure becomes zero by switching each of the switching valves 1 to 5 into the full stroke state, the tilting angle of the first main pump MP1 becomes the maximum, and the displacement amount per one rotation thereof becomes the maximum.

The second circuit system includes: a switching valve 11 for controlling a right-hand side traveling motor; a switching valve 12 for controlling a bucket cylinder; a boom switching valve 13 for controlling the boom cylinder BC; and a switching valve 14 for controlling duel speed of the arm cylinder in order from the upstream side.

The respective switching valves 11 to 14 are connected in series via a neutral flow passage 15. The respective switching valves 11 to 13 are also connected in parallel via a parallel passage 16. The neutral flow passage 15 and the parallel passage 16 are connected to the second main pump MP2. A pilot pressure control throttle 17 is connected to the neutral flow passage 15 on the downstream side of the switching valve 14. The throttle 17 generates higher pilot pressure on the upstream side of the throttle 17 as a flow rate of the working fluid flowing through the throttle 17 is greater.

A pilot flow passage 18 is connected to the neutral flow passage 15 between the lowermost downstream switching valve 14 and the throttle 17. The pilot flow passage 18 is connected to a regulator 19 for controlling a tilting angle of the second main pump MP2. The regulator 19 controls the tilting angle of the second main pump MP2 in inverse proportion to pilot pressure of the pilot flow passage 18, and controls a displacement amount per one rotation of the second main pump MP2. Therefore, when a flow of the neutral flow passage 15 is stopped and the pilot pressure becomes zero by switching each of the switching valves 11 to 14 into the full stroke state, the tilting angle of the second main pump MP2 becomes the maximum, and the displacement amount per one rotation thereof becomes the maximum.

Pressure sensors 20, 21 respectively detect the pilot pressures guided to the regulators 10, 19 and input the pilot pressures to a controller C. A reference numeral E of FIG. 1 denotes an engine serving as a power source of the first main pump MP1 and the second main pump MP2, and a reference numeral 22 denotes a generator linked with the engine E.

Each of the switching valves 1 to 5, 11 to 14 is switched by the pilot pressure generated in accordance with an operation amount of a lever of a pilot operation valve (not shown in the drawings). A stroke detection unit (not shown in the drawings) connected to the controller C is provided in the pilot operation valve. The stroke detection unit detects an operation direction and an operation amount of the pilot operation valve and inputs the direction and the amount to the controller C. The controller C determines a spool stroke of each of the switching valves 1 to 5, 11 to 14 from the operation amount of the lever of the pilot operation valve.

The boom switching valve 13 is connected to one passage 24 communicating with a piston side chamber 23*a* of the boom cylinder BC, and the other passage 25 communicating with a rod side chamber 23*b* of the boom cylinder BC. A regeneration control valve S is provided on the one passage 24.

In a case where the boom switching valve 13 is switched to an upward control position serving as a right side position of FIG. 1, a pressure fluid supplied from the second main pump MP2 via the parallel passage 16 is guided to the one passage 24. A return fluid guided to the other passage 25 from the rod side chamber 23*b* of the boom cylinder BC is returned to the tank T via the boom switching valve 13 switched to the upward control position.

In a case where the boom switching valve 13 is switched to a downward control position serving as a left side position of FIG. 1, the pressure fluid supplied from the second main pump MP2 via the parallel passage 16 is guided to the other passage 25. A return fluid guided to the one passage 24 from the piston side chamber 23*a* of the boom cylinder BC is returned to the tank T via the boom switching valve 13 switched to the downward control position.

Flow channels 26, 27 are provided in the regeneration control valve S. The one flow channel 26 is provided in the middle of the one passage 24 connecting the boom switching valve 13 to the piston side chamber 23*a* of the boom cylinder BC. The other flow channel 27 is provided in the middle of a regeneration flow passage 28 connecting the piston side chamber 23*a* to a fluid pressure motor M. The regeneration flow passage 28 branches from a branch point 29 between the regeneration control valve S and the piston side chamber 23*a*, and is connected in parallel to the one passage 24.

A spring 30 is provided on one side of the regeneration control valve S and a pilot chamber 31 is provided on the other side. The regeneration control valve S is normally retained at a normal position shown in the drawing by means of spring force of the spring 30. In a case where the pilot pressure is applied to the pilot chamber 31, the regeneration control valve S is switched to a regeneration control position serving as a right side position of FIG. 1. At the normal position, the one flow channel 26 is completely opened, and the other flow channel 27 is closed. At the regeneration control position, an opening degree of the one flow channel 26 is retained to be the minimum, and an opening degree of the other flow channel 27 is retained to be the maximum.

The regeneration control valve S is retained at a position where force received by the pilot pressure and the spring force of the spring 30 are balanced, and controls the opening degrees of the one flow channel 26 and the other flow channel 27. It should be noted that the normal position of the regeneration control valve S is a position where the other flow channel 27 is completely closed. In a case where the other flow channel 27 is opened even slightly, the position serves as the regeneration control position. A check valve 32 is provided on the regeneration flow passage 28, and allows only conduction from the regeneration control valve S to the fluid pressure motor M.

In a case where the regeneration control valve S is retained at the normal position shown in the drawing, the one flow channel 26 is completely opened and the other flow channel 27 is closed. Therefore, at the time of extension of the boom cylinder BC at which the pressure fluid is supplied to the one passage 24, the pressure fluid supplied to the one passage 24 is supplied to the piston side chamber 23*a* through the one flow channel 26. At the time of contraction of the boom cylinder BC, the other flow channel 27 is closed. Thus, a total amount of the fluid returned from the piston side chamber 23*a* is guided to the tank T via the one flow channel 26, the one passage 24, and the boom switching valve 13. In such a way, a flow rate returned from the boom cylinder BC to the tank T via the regeneration control valve S will hereinafter be referred to as a "first supply amount".

When the pilot pressure is applied to the pilot chamber 31 of the regeneration control valve S, the regeneration control valve S is switched to the control position serving as the right side position of FIG. 1. A switching amount of the regeneration control valve S is controlled in accordance with the pilot pressure applied to the pilot chamber 31, and thereby controlling the opening degrees of the flow channels 26, 27.

The proportional solenoid valve 33 controls the pilot pressure of the pilot chamber 31. A spring 34 is provided on one side of the proportional solenoid valve 33 and a solenoid 35 is provided on the other side. The proportional solenoid valve 33 is normally retained at a closed position shown in the drawing. When the solenoid 35 is excited, the proportional solenoid valve 33 is switched to an opened position. The solenoid 35 is connected to the controller C, and an opening degree of the proportional solenoid valve 33 is controlled in accordance with a signal from the controller C.

A pilot pump PP is connected to the proportional solenoid valve 33. A control throttle 36 communicating with the tank T is provided between the pilot chamber 31 and the proportional solenoid valve 33. When the spool stroke of the boom switching valve 13 reaches a stroke range set up in advance, the controller C outputs a signal according to a stroke amount to the solenoid 35. It should be noted that as described above, the controller C determines the spool stroke of the boom switching valve 13 in accordance with a signal from the stroke detection unit.

When the solenoid 35 of the proportional solenoid valve 33 is excited by the output signal from the controller C, the opening degree of the proportional solenoid valve 33 is regulated in accordance with the output signal. Therefore, a fluid discharged from the pilot pump PP is supplied to the pilot chamber 31 in accordance with the opening degree of the proportional solenoid valve 33. Since the pilot fluid supplied from the pilot pump PP is guided to the tank T from the control throttle 36, the pilot pressure according to the opening degree of the proportional solenoid valve 33 is applied to the pilot chamber 31. It should be noted that a proportional solenoid pressure-reducing valve may be used in place of the proportional solenoid valve 33. In this case, the control throttle 36 is not required, and the proportional solenoid pressure-reducing valve may be connected to the pilot chamber 31 directly.

When the pilot pressure is applied to the pilot chamber 31, the regeneration control valve S controls the opening degrees of the one flow channel 26 and the other flow channel 27 in accordance with the pilot pressure. For example, in a case where the pilot pressure is low, the opening degree of the one flow channel 26 becomes relatively larger than that of the other flow channel 27. To the contrary, in a case where the pilot pressure is high, the regeneration control valve S is switched against the spring force of the spring 30. Thus, the opening degree of the one flow channel 26 becomes relatively smaller than the opening degree of the other flow channel 27.

When the other flow channel 27 is opened, the return fluid from the boom cylinder BC is guided to the fluid pressure motor M via the flow channel 27 of the regeneration control valve S and the regeneration flow passage 28. Hereinafter, this flow rate guided to the fluid pressure motor M will be referred to as a "second supply amount". The second supply amount is controlled in accordance with an opening degree of the regeneration control valve S. Rotation speed of the fluid pressure motor M and rotation speed of a motor generator MG are controlled in accordance with the second supply amount.

When the other flow channel 27 of the regeneration control valve S is opened and the pressure fluid is guided to the regeneration flow passage 28, the fluid pressure motor M is rotated. The motor generator MG is rotated by means of power of the fluid pressure motor M to perform power generation. The power generated by the motor generator MG is stored in a battery 38 through an inverter 37. It should be noted that the battery 38 is connected to the controller C, and a storage amount of the battery 38 is monitored by the controller C.

In the present embodiment, in order to prevent the motor generator MG from exceeding rated power, setting standard of the spool stroke of the boom switching valve 13 is regulated on the basis of the rated power of the motor generator MG.

Figure 3:
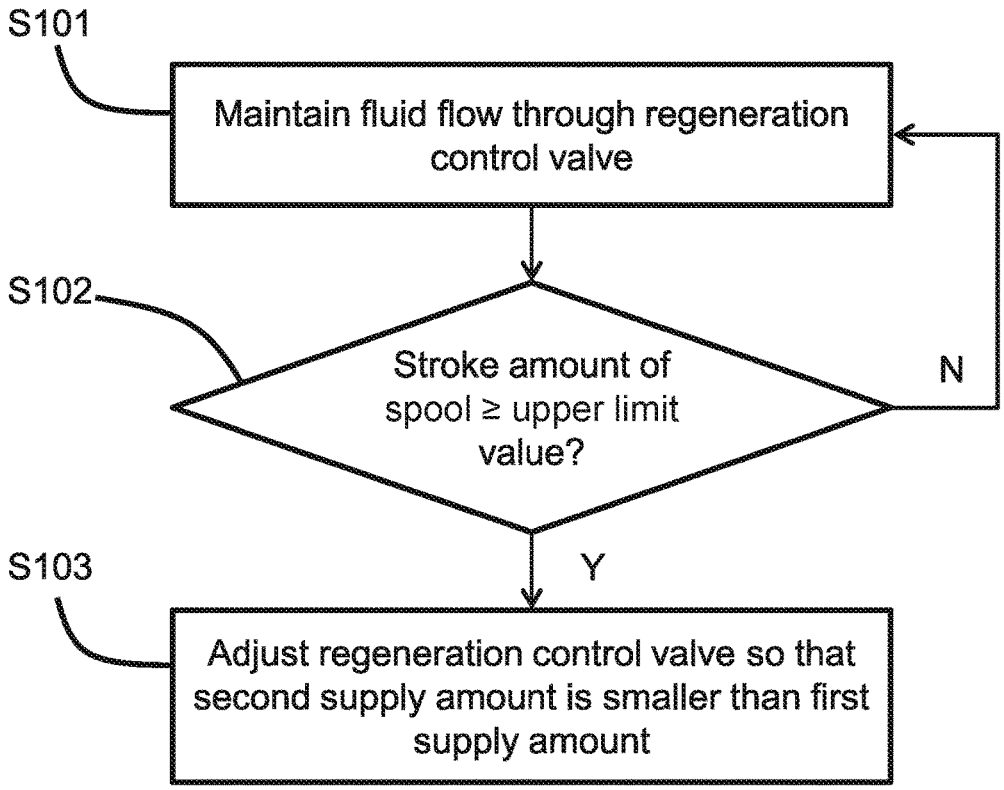
FIG. 3 is a flow diagram of a method by which a controller controls a regeneration control valve.

A flow diagram of the control operation of the controller C is provided in FIG. 3. In a case where the stroke of the boom switching valve 13 is within a setting range, the controller C controls the solenoid 35 to maintain the opening degree of the other flow channel 27 of the regeneration control valve S (FIG. 3, S101), thereby supplying the return fluid from the boom cylinder BC to the fluid pressure motor M. In a case where the stroke of the boom switching valve 13 exceeds the range set up in advance, that is, in a case where the stroke becomes an upper limit value or more of the setting standard (S102), the controller C controls the opening degree of the other flow channel 27 (S103) such that the opening degree of the other flow channel 27 of the regeneration control valve S is made smaller, whereby the second supply amount serving as the flow rate of the return fluid supplied to the fluid pressure motor M is made smaller than the first supply amount serving as the flow rate returned to the boom switching valve 13. Thus, the rotation speed of the fluid pressure motor M is controlled, and the motor generator MG is prevented from being rotated so as to exceed the rated power.

An assist pump AP is rotated coaxially with the fluid pressure motor M, and the assist pump AP and the fluid pressure motor M are linked with the motor generator MG. The assist pump AP is respectively connected to the first main pump MP1 and the second main pump MP2 via flow passages 39, 40 arranged in parallel to each other. A discharged fluid of the assist pump AP joins discharged fluids of the first main pump MP1 and the second main pump MP2. Check valves 41, 42 are respectively placed on the flow passages 39, 40, and the check valves 41, 42 allow only conduction from the assist pump AP to the first main pump MP1 and the second main pump MP2.

Regulators 43, 44 are provided in the fluid pressure motor M and the assist pump AP, respectively. The regulators 43, 44 are connected to the controller C, and respectively control tilting angles of the fluid pressure motor M and the assist pump AP in accordance with signals from the controller C.

Next, operations of the present embodiment will be described.

When the boom switching valve 13 is switched to the upward control position by means of a lever operation of the pilot operation valve linked with the boom switching valve 13, the controller C determines that the boom cylinder BC is under an upward task on basis of the signal from the stroke detection unit. In a case of determining that the boom cylinder BC is under the upward task, the controller C brings the solenoid 35 of the proportional solenoid valve 33 into a non-excited state. Thus, the proportional solenoid valve 33 is retained at the closed position.

When the proportional solenoid valve 33 is retained at the closed position, the pilot pressure is not applied to the pilot chamber 31 of the regeneration control valve S. Thus, the regeneration control valve S is retained at the normal position shown in the drawing by means of an action of the spring force of the spring 30. When the regeneration control valve S is retained at the normal position, the one flow channel 26 is completely opened and the other flow channel 27 is closed.

Therefore, the pressure fluid discharged from the second main pump MP2 is supplied to the piston side chamber 23*a* of the boom cylinder BC through the one passage 24 and the one flow channel 26 of the regeneration control valve S from the boom switching valve 13. The return fluid of the rod side chamber 23*b* of the boom cylinder BC is returned to the tank T through the other passage 25 and the boom switching valve 13. Thus, the boom cylinder BC is operated to be extended.

On the other hand, when the boom switching valve 13 is switched to the downward control position by means of the lever operation of the pilot operation valve linked with the boom switching valve 13, the controller C determines that the boom cylinder BC is under a downward task on the basis of the signal from the stroke detection unit. In a case of determining that the boom cylinder BC is under the downward task, the controller C determines whether or not the spool stroke is within a stroke range set up in advance on the basis of the signal from the stroke detection unit.

When the spool stroke of the boom switching valve 13 is within the set range, the controller C controls an excitation current toward the solenoid 35 of the proportional solenoid valve 33 in accordance with the spool stroke. Thus, the pilot pressure is guided to the pilot chamber 31 of the regeneration control valve S. When the pilot pressure is applied to the pilot chamber 31, the regeneration control valve S is switched to the regeneration control position in accordance with the pilot pressure, and the opening degrees of the one flow channel 26 and the other flow channel 27 are controlled.

The controller C controls a total opening degree of both the flow channels 26, 27 so that downward speed of the boom cylinder BC becomes speed determined by the operation amount of the lever and intended by an operator. At this time, the controller C controls the opening degrees so that the opening degree of the flow channel 27 becomes larger than that of the flow channel 26. Therefore, the return fluid of the boom cylinder BC at the time of downward is divided at the branch point 29 into a return fluid to be returned to the tank T via the one flow channel 26, the passage 24 and the boom switching valve 13, and a return fluid to be returned to the fluid pressure motor M from the other flow channel 27 via the regeneration flow passage 28.

When the fluid is supplied to the fluid pressure motor M, the fluid pressure motor M is rotated. The controller C actuates the regulator 43 of the fluid pressure motor M to control torque of the fluid pressure motor M so that the downward speed of the boom cylinder BC becomes the speed intended by the operator.

The controller C always determines whether or not the boom switching valve 13 is within the range set up in advance of the spool stroke on the basis of the operation amount of the lever of the pilot operation valve. In a case where the spool stroke of the boom switching valve 13 exceeds the range set up in advance, that is, in a case where the spool stroke becomes the upper limit value or more of the setting standard, the controller C reduces the excitation current toward the solenoid 35 of the proportional solenoid valve 33 and thereby reduces the pilot pressure applied to the pilot chamber 31 of the regeneration control valve S.

When the pilot pressure applied to the pilot chamber 31 becomes lower, the regeneration control valve S is moved by means of the action of the spring 30 to throttle the opening degree of the flow channel 27 and relatively increase the opening degree of the flow channel 26. Thus, the flow rate supplied to the fluid pressure motor M becomes smaller, and the rotation speed of the fluid pressure motor M becomes lower.

In a case where the controller C monitors the spool stroke of the boom switching valve 13 and the stroke exceeds the range set up in advance, the controller C actuates the regeneration control valve S to reduce the flow rate supplied to the fluid pressure motor M. Thus, it is possible to prevent the motor generator MG from being rotated so as to exceed the rated power.

Moreover, in a case where the fluid pressure motor M drives and causes the motor generator MG to perform the power generation, the controller C actuates the regulator 44 of the assist pump AP to make the tilting angle of the assist pump AP zero. Thus, it is possible to prevent the assist pump AP from consuming wasteful power.

Moreover, in a case where driving force of the assist pump AP is assisted by the power of the fluid pressure motor M, the controller C actuates the regulator 43 of the fluid pressure motor M to control the torque of the fluid pressure motor M so that the downward speed of the boom cylinder BC becomes the speed intended by the operator.

Moreover, when the controller C monitors the storage amount of the battery 38 and the battery 38 is in a fully charged state, the controller C actuates the regulator 43 provided in the fluid pressure motor M to make the tilting angle of the fluid pressure motor M zero. Here, when the tilting angle of the fluid pressure motor M becomes zero, a load thereof comes close to zero. However, in order not to influence the downward speed of the boom cylinder BC even when the load becomes zero, the controller C controls the proportional solenoid valve 33 to control the flow channels 26 and 27 of the regeneration control valve S.

Figure 2:
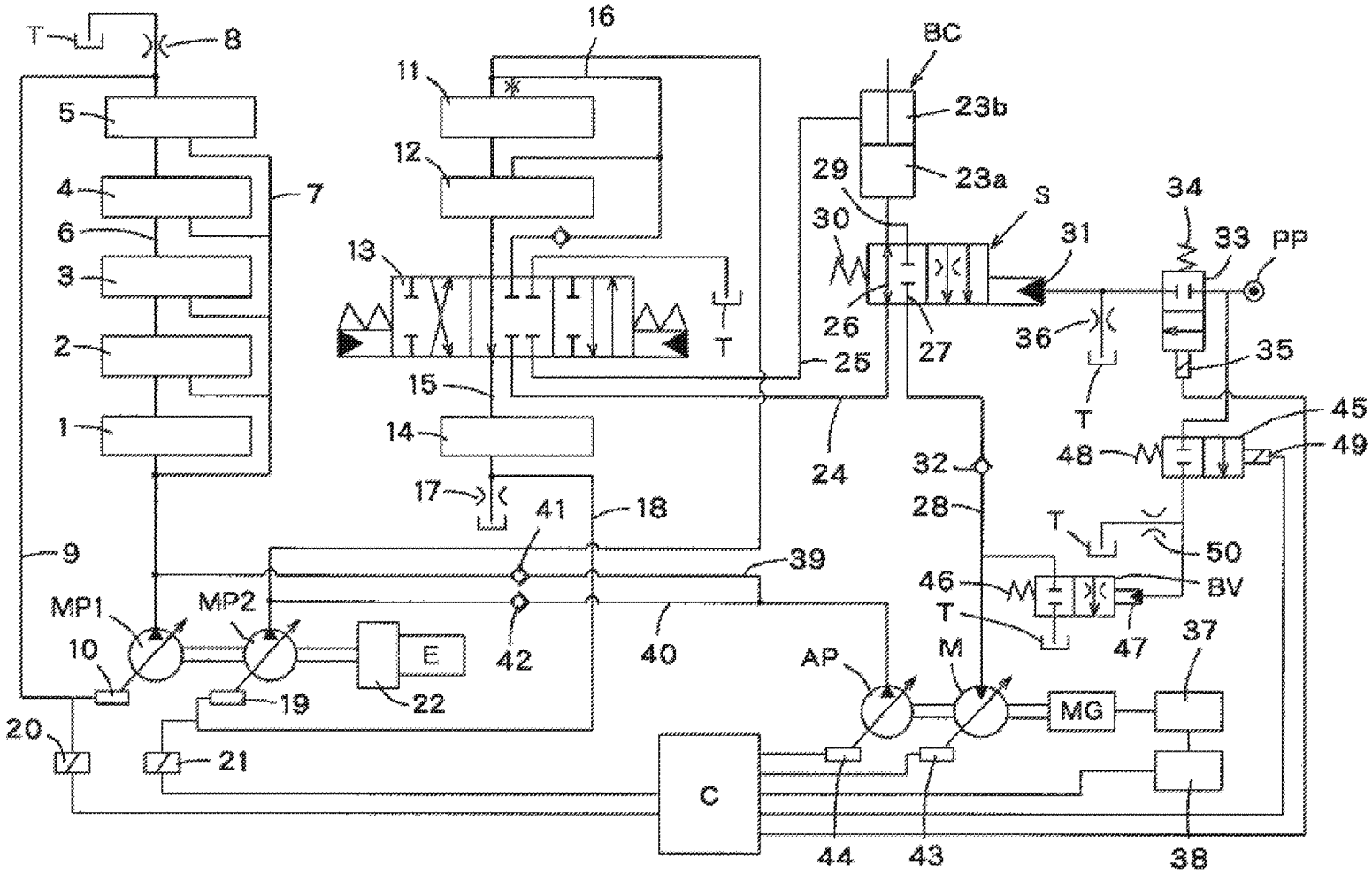
FIG. 2 is a hydraulic circuit diagram of a control system for a construction machine according to a second embodiment of the present invention.

Referring to FIG. 2, a second embodiment will be described.

A control system for a construction machine of the present embodiment is different from the first embodiment only in a point that a bleed-off valve BV provided on the regeneration flow passage 28 and a proportional solenoid valve 45 for controlling the bleed-off valve BV are provided. Therefore, the same reference numerals will be used for the same constituent elements as the first embodiment, and detailed description of the elements will be omitted.

A spring 46 is provided on one side of the bleed-off valve BV and a pilot chamber 47 is provided on the other side. The bleed-off valve BV is normally retained at a closed position serving as a normal position shown in the drawing by means of an action of spring force of the spring 46. When the pilot pressure is applied to the pilot chamber 47, the bleed-off valve BV is switched to a control position serving as a right side position of FIG. 2. When the bleed-off valve BV is switched to the control position, part of a flow rate of the regeneration flow passage 28 is guided to the tank T. An opening degree of the bleed-off valve BV is controlled by the pilot pressure applied to the pilot chamber 47.

The proportional solenoid valve 45 controls the pilot pressure of the pilot chamber 47. A spring 48 is provided on one side of the proportional solenoid valve 45 and a solenoid 49 is provided on the other side. The proportional solenoid valve 45 is normally retained at a closed position shown in the drawing. When the solenoid 49 is excited, the proportional solenoid valve 45 is switched to an opened position. The solenoid 49 is connected to the controller C, and an opening degree of the proportional solenoid valve 45 in a switching process from the close position to the opened position is controlled in accordance with the signal from the controller C.

The pilot pump PP is connected to the proportional solenoid valve 45. A control throttle 50 communicating with the tank T is provided between the pilot chamber 47 and the proportional solenoid valve 45. In a case where the spool stroke of the boom switching valve 13 becomes a stroke set up in advance or more, that is, in a case where the spool stroke becomes the upper limit value or more of the setting standard, the controller C outputs a signal according to the stroke amount to the solenoid 49. The controller C determines the spool stroke of the boom switching valve 13 in accordance with the operation amount of the lever provided in the pilot operation valve.

When the solenoid 49 of the proportional solenoid valve 45 is excited by means of the output signal from the controller C, the opening degree of the proportional solenoid valve 45 is determined in accordance with the output signal. The fluid discharged from the pilot pump PP is supplied to the pilot chamber 47 of the bleed-off valve BV in accordance with the opening degree of the proportional solenoid valve 45. Since the pilot fluid supplied from the pilot pump PP is guided to the tank T from the control throttle 50, the pilot pressure according to the opening degree of the proportional solenoid valve 45 is applied to the pilot chamber 47.

When the pilot pressure is applied to the pilot chamber 47 of the bleed-off valve BV, the bleed-off valve BV is switched to the control position and the opening degree of the bleed-off valve BV is controlled in accordance with the pilot pressure. Therefore, part of the flow rate supplied to the regeneration flow passage 28 is returned to the tank T via the bleed-off valve BV.

In such a way, since the part of the flow rate supplied to the regeneration flow passage 28 is returned to the tank T, it is possible to prevent the motor generator MG from being rotated so as to exceed the rated power due to an increase in the rotation speed of the fluid pressure motor M. Therefore, as well as the first embodiment, it is possible to prevent the motor generator MG from causing breakage due to the rotation exceeding the rated power.

It should be noted that a proportional solenoid pressure-reducing valve may be used in place of the proportional solenoid valve 45. In this case, the control throttle 50 is not required, and the proportional solenoid pressure-reducing valve may be connected to the pilot chamber 47 directly.

Embodiments of this invention were described above, but the above embodiments are merely examples of applications of this invention, and the technical scope of this invention is not limited to the specific constitutions of the above embodiments.

This application claims priority based on Japanese Patent Application No. 2012-164518 filed with the Japan Patent Office on Jul. 25, 2012, the entire contents of which are incorporated into this specification.

The invention claimed is:

1. A control system for a construction machine, comprising:

a boom cylinder partitioned into a piston side chamber and a rod side chamber by a piston, the boom cylinder operating so as to be extended and contracted by supplying a working fluid to the piston side chamber or the rod side chamber, thereby driving a boom;

a boom switching valve adapted to adjust a supply amount of the working fluid to be supplied to the piston side chamber or the rod side chamber by means of a stroke of a spool;

a fluid pressure motor adapted to drive a motor generator by being rotated by means of a return fluid guided from the piston side chamber;

a regeneration control valve adapted to communicate the piston side chamber with the boom switching valve and the fluid pressure motor, the regeneration control valve being adapted to adjust a first supply amount and a second supply amount, the first supply amount serving as a supply amount of the working fluid supplied from the piston side chamber to the boom switching valve, the second supply amount serving as a supply amount of the working fluid supplied from the piston side chamber to the fluid pressure motor; and a controller adapted to control the regeneration control valve so that the second supply amount becomes smaller than the first supply amount in response to a determination that a stroke amount of the spool becomes an upper limit value or more.

2. A control system for a construction machine, comprising:

a boom cylinder in which a piston side chamber and a rod side chamber are formed by a piston, the boom cylinder operating so as to be extended and contracted by supplying a working fluid to the piston side chamber or the rod side chamber, thereby driving a boom;

a boom switching valve adapted to adjust a supply amount of the working fluid to be supplied to the piston side chamber or the rod side chamber by means of a stroke of a spool;

a fluid pressure motor adapted to drive a motor generator by being rotated by means of a return fluid guided from the piston side chamber;

a regeneration control valve adapted to communicate the piston side chamber with the boom switching valve and the fluid pressure motor, the regeneration control valve being adapted to adjust a supply amount of the working fluid supplied from the piston side chamber to the boom switching valve and a supply amount of the working fluid supplied from the piston side chamber to the fluid pressure motor;

a bleed-off valve provided on a passage connecting the regeneration control valve to the fluid pressure motor, the bleed-off valve communicating or blocking between the piston side chamber and a tank at a drain side; and a controller adapted to, in a case where a stroke amount of the spool becomes an upper limit value or more, control an opening degree of the bleed-off valve in accordance with the stroke amount to communicate the piston side chamber with the tank.

3. The control system for the construction machine according to claim 1, wherein the regeneration control valve includes:

a pilot chamber connected to a pilot pressure source via a proportional solenoid valve; and a spring provided on the opposite side of the pilot chamber, the spring being adapted to exert spring force for pressing the spool toward the side of the pilot chamber, and wherein the controller controls the opening degree of the regeneration control valve by controlling the proportional solenoid valve to apply pilot pressure to the pilot chamber.

4. The control system for the construction machine according to claim 1, wherein the upper limit value is set up on the basis of rated power of the motor generator.

* * * * *